US009877134B2

(12) United States Patent
Kirsch

(10) Patent No.: US 9,877,134 B2
(45) Date of Patent: Jan. 23, 2018

(54) TECHNIQUES FOR OPTIMIZING THE FIDELITY OF A REMOTE RECORDING

(71) Applicant: HARMAN INTERNATIONAL INDUSTRIES, INC., Stamford, CT (US)

(72) Inventor: James M. Kirsch, Salt Lake City, UT (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 14/811,751

(22) Filed: Jul. 28, 2015

(65) Prior Publication Data

US 2017/0034640 A1 Feb. 2, 2017

(51) Int. Cl.

| | |
|---|---|
| ***H04R 1/40*** | (2006.01) |
| ***H04S 7/00*** | (2006.01) |
| ***H04R 5/04*** | (2006.01) |
| *H04R 3/00* | (2006.01) |

(52) U.S. Cl.

CPC ..... *H04S 7/30* (2013.01); *H04R 5/04* (2013.01); *H04R 3/005* (2013.01); *H04S 2400/11* (2013.01); *H04S 2400/15* (2013.01); *H04S 2420/07* (2013.01)

(58) Field of Classification Search

CPC ..... H04R 25/43; H04R 2420/01; H04R 5/04; H04R 3/00; H04S 2400/15; H04S 1/002; H04S 2420/07; H04S 2400/11

USPC ..... 381/17, 91–92, 118–119

See application file for complete search history.

(56) References Cited

U.S. PATENT DOCUMENTS

| | | | | |
|---|---|---|---|---|
| 4,066,842 | A * | 1/1978 | Allen | G10K 11/002 381/66 |
| 8,542,849 | B2 * | 9/2013 | Bruey | H04R 3/00 369/4 |
| 8,577,045 | B2 * | 11/2013 | Gibbs | G10L 19/008 381/1 |
| 9,002,036 | B2 * | 4/2015 | Harney | H04R 1/245 381/122 |
| 9,078,077 | B2 * | 7/2015 | Hultz | H04S 3/008 |
| 2006/0159291 | A1 * | 7/2006 | Fliegler | G10H 1/0066 381/118 |

(Continued)

*Primary Examiner* — Disler Paul

(74) *Attorney, Agent, or Firm* — Artegis Law Group, LLP

(57) ABSTRACT

In one embodiment, a recording optimizer included in a recorder optimizes the fidelity of output signals. In operation, the recorder receives and records two sets of input signals—one set of input signals received via microphones included in the recorder and another set of input signals received as line-inputs from a front of house console mixer. The recording optimizer analyzes the recorded signals to identify discrepancies, such as unamplified instruments that are underrepresented in the line-inputs. The recording optimizer then performs compensation operations that adjust one or more recorded signals to mitigate the discrepancies. Subsequently, the recording optimizer combines the compensated recorded signals, generating output signals that leverage the strengths of both sets of input signals to accurately represent the experienced sound. By contrast, conventional recorder/mixer combinations may produce output signals with degraded fidelity attributable to unresolved discrepancies between the source signals.

22 Claims, 5 Drawing Sheets

(56) References Cited

U.S. PATENT DOCUMENTS

| | | | | |
|---|---|---|---|---|
| 2013/0003998 | A1* | 1/2013 | Kirkeby | G05B 23/0235 381/300 |
| 2014/0294200 | A1* | 10/2014 | Baumgarte | H03G 3/20 381/107 |
| 2014/0376743 | A1* | 12/2014 | Hetherington | H03G 3/20 381/94.2 |
| 2014/0376744 | A1* | 12/2014 | Hetherington | H03G 3/20 381/94.2 |
| 2015/0098571 | A1* | 4/2015 | Jarvinen | H04S 7/301 381/1 |

* cited by examiner

Mic Preprocessor Psuedocode
320

```
high pass filter rec mic L sig and rec mic R sig to 40Hz
normalize (by energy) rec mic L sig and rec mic R sig
```

Line-in Preprocessor Psuedocode
330

```
XCL = crosscorrelate(rec line-in L sig,
                     rec line-in R sig)
if XCL > 0.7
        normalize (by energy) rec line-in L sig and
                     rec line-in R sig
else
        temp = 0.6 * rec line-in L sig +
                     0.4 * rec line-in R sig
        rec line-in R sig = 0.6 * rec line-in R sig +
                     0.4 * rec line-in L sig
        rec line-in L sig = temp
end If
```

Bass Adjustment Subsystem Psuedocode
350

```
line bass = low pass filter (rec line-in L sig  + rec line-in R sig)
                     to 130Hz
line treble  = high pass filter ( rec line-in L sig  +
                     rec line-in R sig ) to 130Hz
if line bass / line treble > 0.2
        // bass is present in rec line-in sigs
        high pass filter rec mic L sig and rec mic R sig
                     to 130Hz
        band pass filter rec line-in L sig and rec line-in R sig
                     between 30Hz and 130Hz
        amplify rec line-in L sig and rec line-in R sig by 6dB
else
        // bass is absent in rec line-in sigs
        band pass filter rec mic L sig and rec mic R sig
                     between 30Hz and 130Hz
        amplify rec mic L sig and rec mic R sig by 6dB
end
```

Time Alignment Subsystem Psuedocode
340

```
mic delay =
        find(peak(crosscorrelate(
                     (rec line-in L sig + rec line-in R sig),
                     (rec mic L sig + rec mic R sig))))
apply mic delay to rec line-in L sig and
                     rec line-in R sig
```

Subjective Customizer Psuedocode
370

```
apply subjective delay to rec mic L sig  and rec mic R sig
rec line-in L sig  = subjective line gain * rec line-in L sig
rec line-in R sig  = subjective line gain *  rec line-in R sig
```

Panning Checker/Swapper Psuedocode
360

```
// ensure panning not swapped
XCnorm = crosscorrelate(rec line-in L sig, rec mic L sig) +
        crosscorrelate(rec line-in R sig, rec mic R sig)
XCrev = crosscorrelate(rec line-in L sig, rec mic R sig) +
        crosscorrelate(rec line-in R sig, rec mic L sig)
if XCrev > XCnorm
        temp = rec line-in L sig
        rec line-in L sig = rec line-in R sig
        rec line-in R sig = temp
end If
```

Signal Combiner Psuedocode
390

```
recording out L sig = rec mic L sig + rec line-in L sig
recording out R sig = rec mic R sig + rec line-in R sig
```

FIGURE 3

TECHNIQUES FOR OPTIMIZING THE FIDELITY OF A REMOTE RECORDING

BACKGROUND

Field of the Various Embodiments

The various embodiments relate generally to acoustics technology and, more specifically, to techniques for optimizing the fidelity of a remote recording.

Description of the Related Art

Oftentimes, remote recording devices include various microphones used to record, from a distance, acoustic audio signals associated with a performance. For example, a handheld recorder may include one or more microphones and may be configured to generate a stereo recording of the sounds received via the microphones during a performance. Typically, the stereo recordings captured by such remote recording devices accurately reflect the performances as perceived at the locations of the remote recording devices. However, since the microphones may pick up ambient noises such as crowd noise, wind noise, building noise, traffic noise, room reverberation, etc., the quality of the recorded signals may be relatively low.

In an attempt to improve the quality of the recorded signals captured by remote recording devices, some remote recording devices have been designed to include line-in inputs that enable the remote recording device to receive electronic audio signals. Typically, the electronic audio signals received by remote recording devices are relayed from a front of house console mixer that processes signals received via different "instrument" pickups (e.g., output of an electric guitar, on-stage microphones that target different speakers or singers, etc.). Notably, the electric audio signals received via line-in inputs are typically cleaner than acoustic audio signals. More specifically, since the electronic audio signals are relayed from the source of the sounds (i.e., the stage), the electronic audio signals are less likely to pick up ambient noise and may provide a "purer" version of the performance than the acoustic audio signals received via the microphones included in the remote recording devices. In operation, the remote recording device writes separate tracks for each of the acoustic audio signals and the electronic audio signals—recording the performance. Subsequently, a mixing application combines the recorded tracks to generate recording output signals in an effort to reinforce the desired sounds while reducing the negative impact of ambient noises, such as crowd noise.

One problem with mixing the acoustic audio signals with the electronic audio signals in the fashion described above is that the underlying content included in the two sets of signals may vary. For example, the instrument pickups and the front of house console mixer could be configured to amplify a singer but not a bass guitar. In such a scenario, the electronic signals transmitted to the recording device via the line-in inputs would include contributions from the singer but little or no contributions from the bass guitar. By contrast, the acoustic audio signals received via the recording microphones would include contributions from both the signer and the bass guitar. When the mixing application combines the two sets of recorded tracks to produce the recording output signals, the signer would be overrepresented in the mix and the bass guitar would be underrepresented in the mix. Consequently, the recording output signals would not properly convey the reality of the performance as perceived by the listener. Other discrepancies between the acoustic audio signals and the electronic audio signals may also further reduce the fidelity of the recording output signals. For example, because the microphones included in the remote recording device could be relatively far from the stage, the acoustic audio signals could exhibit a noticeable time lag relative to the electronic audio signals.

As the foregoing illustrates, more effective techniques for generating remote recordings of performances would be useful.

SUMMARY

One embodiment sets forth a computer-implemented method for generating a remote recording of a performance. The method includes detecting a discrepancy between a first audio input signal associated with the performance and a second audio input signal associated with the performance, performing a compensation operation on the first audio input signal based on the discrepancy to generate a first compensated signal, and combining the first compensated signal and the second audio input signal to generate a first audio mix signal.

Further embodiments provide, among other things, a system and a non-transitory computer-readable medium configured to implement the method set forth above.

At least one advantage of the disclosed techniques is that remote recording devices may produce higher fidelity recordings that accurately reflect the performance as perceived by the listener. More specifically, by strategically supplementing acoustic audio signals received via microphones included in the recording device with electronic audio signals received via line-in inputs, the recording device reduces ambient noise while ensuring the appropriate representation of signal components, such as bass components, in the recordings.

BRIEF DESCRIPTION OF THE DRAWINGS

So that the manner in which the above recited features of the various embodiments can be understood in detail, a more particular description, briefly summarized above, may be had by reference to embodiments, some of which are illustrated in the appended drawings. It is to be noted, however, that the appended drawings illustrate only typical embodiments and are therefore not to be considered limiting of its scope, and the various embodiments may admit to other equally effective embodiments.

FIG. 3 depicts excerpts of pseudocode that implement one or more aspects of the recording optimizer of FIG. 2, according to various embodiments;

DETAILED DESCRIPTION

In the following description, numerous specific details are set forth to provide a more thorough understanding of the various embodiments. However, it will be apparent to one of skill in the art that the various embodiments may be practiced without one or more of these specific details.

Overview of Performance System

Figure 1:
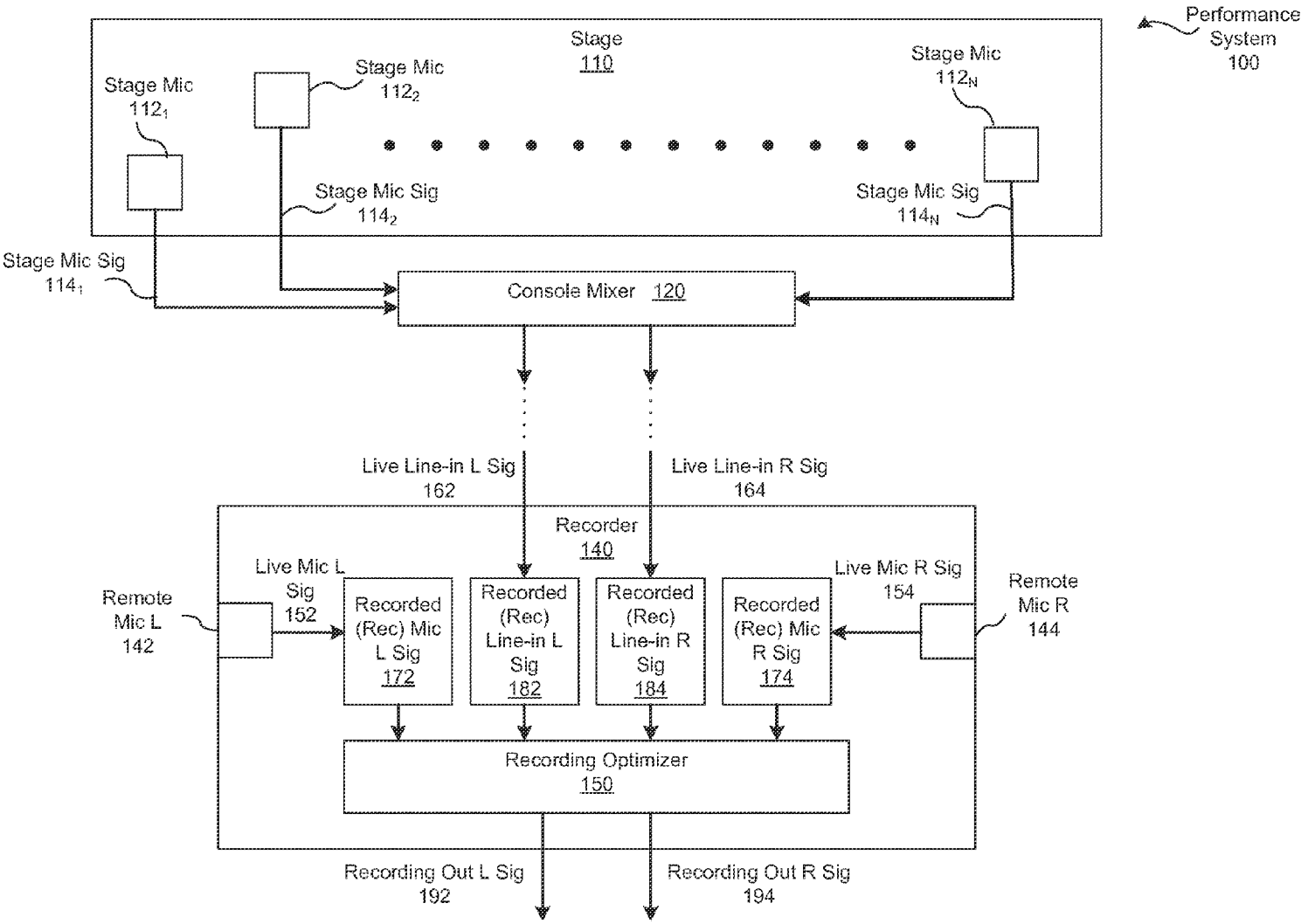
FIG. 1 illustrates a performance system configured to implement one or more aspects of the various embodiments.

FIG. 1 illustrates a performance system 100 configured to implement one or more aspects of the various embodiments. As shown, the performance system 100 includes, without limitation, a stage 110, a console mixer 120, and a recorder 140. In alternate embodiments, the performance system 100 may be implemented in other structures or locales and may include other types of sensory recording equipment deployed and distributed in any technically feasible manner. For example, in some embodiments and without limitation, the performance system could be located in a lecture hall and could include speakers at each of many seats, a telecoil loop in the ceiling, and multiple recorders that each include a telecoil receiver.

Among other things, the stage 110 includes any number of stage microphones (mics) 112 that receive sounds generated on the stage 110 and then convert the sounds into stage microphone signals (stage mic sigs) 114. Accordingly, the stage mic sigs 114 may correspond to different sounds, such as bass guitar, vocalist, drums, etc., as perceived at different locations on the stage 110. As shown, the stage mic sigs 114 are routed to the console mixer 120. The routing may be implemented in any technically feasible fashion, such as via audio cables, any type of wireless communication system, or the like. In operation, the console mixer 120 performs mixing operations on any number of audio channels, including the stage mic sigs 114, and generates output electronic audio signals that are routed to the recorder 140 as a live line-input left signal (live line-in L sig) 162 and a live line-input right signal (live line-in R sig) 164.

Although not shown, the console mixer 120 typically includes multiple selection mechanisms that enable a sound engineer to tailor the mixing operations to convey desired performance characteristics. For example, and without limitation, the console mixer 120 may include a volume knob, a mute button, and a multi-deck controller to mix audio channels. Ideally, the sound engineer monitors the sound and uses the console mixer 120 to dynamically generate mixed audio signals (i.e. the live rec line-in L/R sigs 182/184) that optimize the entertainment experience for the audience.

The recorder 140 includes, without limitation, a remote microphone left (remote mic L) 142, a remote microphone right (remote mic R) 144, and a recording optimizer 150. In operation, the remote mics L/R 142/144 are configured to receive sounds and convert the sounds to acoustic audio signals, shown as live microphone left/right signals (live mic L/R sigs) 152/154. Subsequently, the recorder 140 stores the live rec mic L/R sigs 152/154 as recorded (rec) mic L/R sigs 172/174. In a complementary fashion, the recorder 140 receives the live rec line-in L/R sigs 162/164 (transmitted from the console mixer 120) and then stores the live rec line-in L/R sigs 162/164 as recorded (rec) line-in L/R sigs 182/184. The recording optimizer 150 then performs mixing operations on the recorded (rec) mic L/R sigs 172/174 and the recorded (rec) line-in L/R sigs 182/184 to produce a recording out left signal (recording out L sig) 192 and a recoding out right signal (recording out R sig) 194. In this fashion, the recorder 140 receives and processes acoustic audio input signals that represent sounds experienced at a typically significant distance from the stage 110 in addition to electronic audio input signals that represent sounds generated on the stage 110 as experienced on the stage 110.

In general, the recorder 140 may be implemented in any number and types of units that, together, are configured to receive input acoustic audio signals from microphones that are not located on the stage 110 as well as input electronic audio signals via line-in connections, and then generate audio mixed signals. For example, in some embodiments and without limitation, the recorder 140 may be implemented in a smartphone. More specifically, the remote mic L/R 142/144 may be stereo microphones included the smartphone and the recording optimizer 150 may be an application that is executed by a processing unit included in the smartphone. In alternate embodiments, the recorder 140 may be implemented as a stand-alone, dedicated handheld recording device. In yet other embodiments, the recorder 140 may be a multitrack recording device that receives four input electronic audio signals—two signals transmitted from a separate but proximate stereo microphone and two from the console mixer 120.

Typically, conventional recorders are configured to capture either a monophonic listening experience or a stereo listening experience. If a conventional recorder is configured to capture a monophonic listening experience, then the conventional recorder will often relay the recorded signals to an external mixing device that performs monophonic mixing operations. For example, and without limitation, the external mixing device could perform naïve summation operations between the input audio signals irrespective of source (i.e., remote microphone, line-input, left, right, etc.) to create a single audio mixed signal. Similarly, if a conventional recorder is configured to capture a stereo listening experience, then the conventional recorder will often relay the recorded signals to an external mixing device that performs stereoscopic mixing operations. For example, and without limitation, the external mixing device could indiscriminately combine all inputs audio signals associated with the left side to create a "left" audio mixed signal and all input audio signals associated with the right side to create a "right" audio mixed signal. However, such straight-forward mixing operations may lead to overrepresentation and/or underrepresentation of sound sources (e.g., singer, drums, bass guitar, etc.) in the generated audio mixed signals. More specifically, there may be many differences between the content included in the remote acoustic audio signals and the content included in the electronic audio signals that corrupt the audio mixed signals produced by the combination of conventional recorders and simplistic mixing operations.

For example, and without limitation, because the sensitivities of the remote mics L/R 142/144 may be unrelated to the output voltage of the console mixer 120, the average levels of the rec mic L/R sigs 172/174 and the rec line-in L/R sigs 182/184 may be different. In some embodiments, without limitation, the distance between the remote mics L/R 142/144 and the stage 110 may be substantial. For example, and without limitation, the stage 110 may be located at the front of a large arena and the remote mics L/R 142/144 may be located at the back of the arena. Accordingly, the rec mic L/R sigs 172/174 may be delayed significantly (e.g., on the order of hundreds of milliseconds) relative to the rec line-in L/R sigs 182/184.

In various embodiments, without limitation, the spread of the left-right panning may differ between the rec mic L/R sigs 172/174 and the re line-in L/R sigs 182/184. Because the stage mics 112 are closer to the stage 110 than the remote mics L/R 142/144, the panning of the stage mics 112 may be wider. Further, the console mixer 120 may be configured to intentionally propagate or add panning to implement various effects across the rec line-in L/R sigs 182/184 that are not necessarily desired in the recording out L/R sigs 192/194. For example, and without limitation, the console mixer 120 may be configured to skew the contributions of a subset of instruments to the left side and skew the contributions of the remaining instruments to the right side. More typically, the output of the console mixer 120 may be monophonic.

In other embodiments, without limitation, the left-right panning may differ between the rec mic L/R sigs 172/174 and the rec line-in L/R sigs 182/184 for a variety of unintentional reasons, including user error. For example, and without limitation, the recorder 140 may accidently be held or mounted upside-down (although the remote mics L/R 142/144 may still be facing toward the stage 110), causing the rec mic L/R sigs 172/174 to exhibit left/right panning that is reversed relative to the rec line-in L/R sigs 182/184. Alternatively, and without limitation, the connections of the rec line-in L/R sigs 182/184 to the recorder 140 may be inadvertently swapped.

In general, the remote mics L/R 142/144 are more likely to pick-up ambient and undesirable sounds than the stage mics 112. Such ambient sounds may include, without limitation, audience noise, traffic noise, weather, noise, room reverberation, and the like. Consequently, the rec line-in L/R sigs 182/184 may represent a "purer" or "cleaner" signal than the rec mic L/R sigs 172/174. Conversely, the remote mics L/R 142/144 may pick-up bass guitar and/or other loud instruments that are intentionally omitted from the rec line-in L/R sigs 182/184. For example, and without limitation, the stage 110 may include a large bass amp and the stage mics 112 may not be directed toward the bass guitar. In such a scenario, the console mixer 120 would not receive significant contributions from the bass guitar and, consequently, the rec line-in L/R sigs 182/184 could represent a less complete version of the listening experience than the rec mic L/R sigs 172/174.

Optimizing Fidelity of Recording Output Signals

To address the aforementioned source signal composition differences, the recording optimizer 150 is configured to selectively combine the signal components included in the rec mics L/R sigs 172/174 and the signal components included in the rec line-in L/R sigs 182/184. More specifically, as part of generating the recording out L/R sigs 192/194, the recording optimizer 150 amplifies the "clean" signal components while attenuating the "noisy" signal components included in each of the rec mic L/R sigs 172/174 and the rec line-in L/R sigs 182/184. In operation, the recording optimizer 150 analyzes the rec mic L/R sigs 172/174 and the rec line-in L/R sigs 182/184 to identify differences between the rec mic L/R sigs 172/174 and the rec line-in L/R sigs 182/184 that could impact a mixture of these signals. Based on these identified differences, the recording optimizer 150 adjusts any number of the rec mic L/R sigs 172/174 and the rec line-in L/R sigs 182/184 to increase the fidelity of the listening experience conveyed by the combination of these signals—the recording out L/R sigs 192/194. In alternate embodiments, the recorder 140 and the recording optimizer 150 may be implemented in separate units and the recorder 140 may transmit the rec mic L/R sigs 172/174 and the rec live-in L/R sigs 182/184 to the recording optimizer 150 in any technically feasible fashion. For example, in some embodiments and without limitation, any number and combination of the remote microphones 142/144, the recorder 140, and the recording optimizer 150 may be implemented as separated units that are coupled together wirelessly or by portable media.

Figure 2:
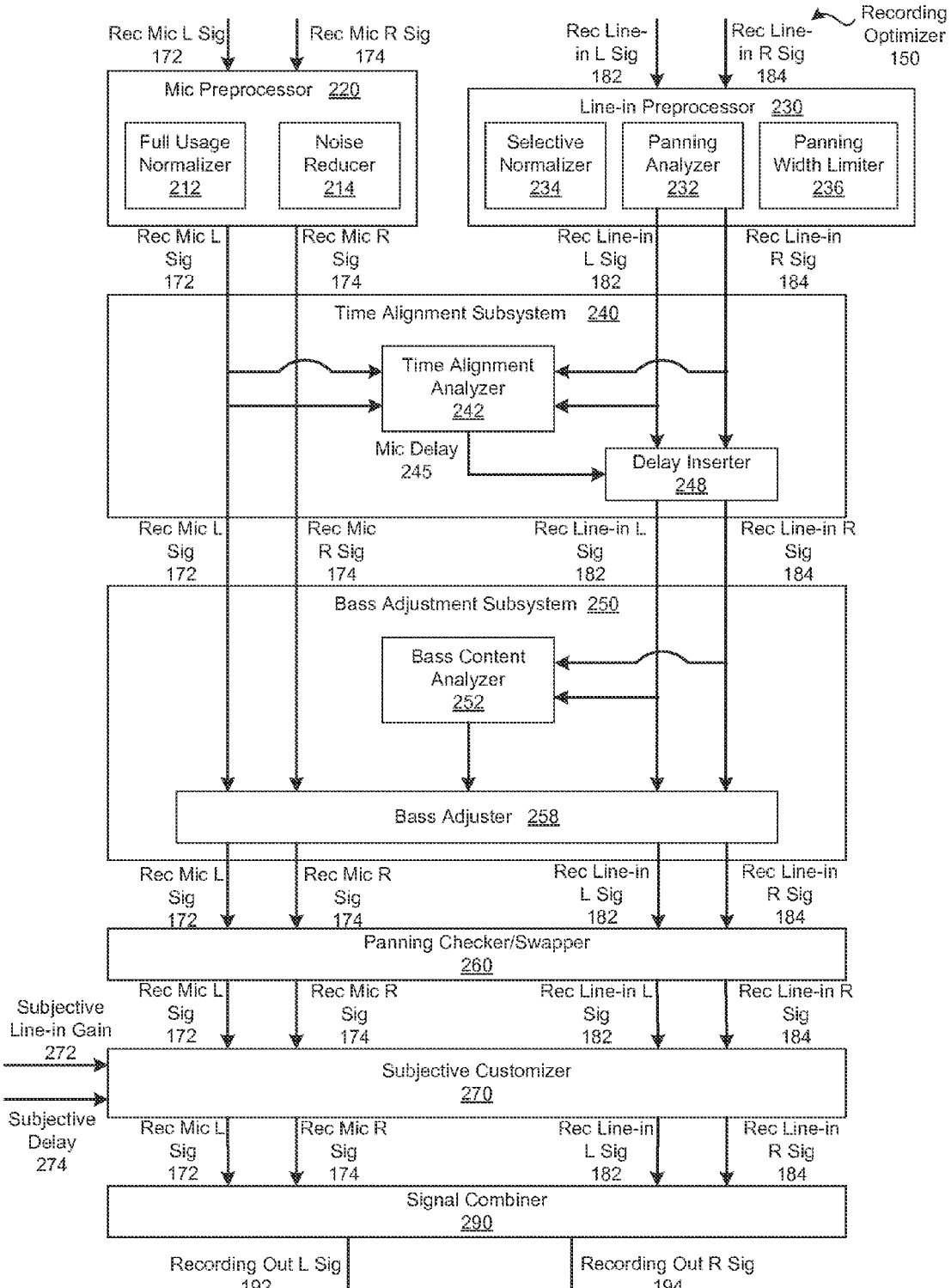
FIG. 2 is a more detailed illustration of the recording optimizer of FIG. 1, according to various embodiments.

FIG. 2 is a more detailed illustration of the recording optimizer 150 of FIG. 1, according to various embodiments. As shown, the recording optimizer 150 includes a microphone preprocessor (mic preprocessor) 220, a line-in preprocessor 230, a time alignment subsystem 240, a bass adjustment subsystem 250, a panning checker/swapper 260, a subjective customizer 270, and a signal combiner 290. In alternate embodiments, without limitation, any number of units may provide the functionality included in the recording optimizer 150 and the units may be implemented in software, hardware, or any combination of software and hardware.

The mic preprocessor 220 includes, without limitation, a full usage normalizer 212 and a noise reducer 214. Upon receiving the rec mic L sig 172 and the rec mic R sig 174, the full usage normalizer 212 normalizes the rec mic L sig 172 and the rec mic R sig 174 by signal energy. The full usage normalizer 212 may perform any number and type of normalization operations in any technically feasible fashion. In some embodiments, without limitation, the microphone preprocessor 220 amplifies the rec mic L sig 172 and the rec mic R sig 174 to fully utilize an available dynamic range. For example, and without limitation, if sixteen bits were to be available for encoding volume levels, then the microphone preprocessor 220 could scale each of the rec mic L sig 172 and the rec mic R sig 174 to span sixteen bits.

Upon receiving the rec mic L sig 172 and the rec mic R sig 174, the noise reducer 214 performs one or more noise reduction operations. For example and without limitation, to reduce low-frequency, undesirable noises, the noise reducer 214 may perform a high pass filtering operation that significantly attenuates signal components of the rec mic L/R sigs 172/174 with frequencies lower than those at which desired sounds are likely to occur. The noise reducer 214 may be configured to enforce any lower threshold, such as the low E of a four string bass (41 hertz) or the low B of a 5/6 string bass (31 hertz).

The line-in preprocessor 230 includes, without limitation, a panning analyzer 232, a selective normalizer 234, and a panning width limiter 236. Upon receiving the rec line-in L/R sigs 182/184, the panning analyzer 232 performs a cross-correlation operation on rec line-in L/R sigs 182/184. Based on the results of the cross-correlation, the panning analyzer 232 estimates the width of the panning between the rec line-in L sig 182 and the rec line-in R sig 184.

If the rec line-in L/R sigs 182/184 are relatively correlated, then the panning analyzer 232 determines that the rec line-in L sig 182 and the rec line-in R sig 184 are relatively narrowly panned. In such a scenario, the selective normalizer 234 then processes the rec line-in L/R sigs 182/184—normalizing the rec line-in L/R sigs 182/184 by signal energy. In some embodiments, without limitation, the selective normalizer 234 mimics the functionality of the full usage normalizer 212. More specifically, the selective normalizer 234 amplifies the rec line-in L sig 182 and the rec line-in R sig 184 to fully utilize an available dynamic range. Typically, the available dynamic range implemented by the selective normalizer 234 matches the available dynamic range implemented by the full usage normalizer 212 and, consequently, the rec line-in L sig 182, the rec line-in R sig 184, rec mic L sig 172, and the rec mic R sig 174 are normalized to the same scale.

Alternatively, if the rec line-in L/R sigs 182/184 are relatively uncorrelated, then the panning analyzer 232 determines that the rec line-in L sig 182 and the rec line-in R sig 184 are independent. For example, and without limitation, some instruments may be included in the rec line-in L sig 182 but may not be included in the rec line-in R sig 184, while other instruments may not be included in the rec line-in L sig 182 but may be included in the rec line-in R sig 184. While such a wide pan may be desirable for some types of special effects implemented by the console mixer 120, typically a wide pan is not replicated in the rec mic L/R sigs 172/174 and, consequently, the wide pan could corrupt a mix of the rec line-in L/R sigs 182/184 and the rec mic L/R sigs 172/174. For these reasons, the panning width limiter 236 is configured to perform any number and type of panning reduction operations on the rec line-in L/R sigs 182/184. For example, and without limitation, the panning width limiter 236 may redistribute the signal components included the rec line-in L/R sigs 182/184 more evenly between the rec line-in L/R sigs 182/184.

In alternate embodiments and without limitation, the mic preprocessor 220 and the line-in preprocessor 230 may work together to scale the rec line-in L sig 182, the rec line-in R sig 184, the rec mic L sig 172, and the rec mic R sig 174 in any fashion that is consistent with the desired audio mix. In some such embodiments, without limitation, the mic preprocessor 220 and the line-in preprocessor 230 may adjust the levels of the rec line-in L sig 182, the rec line-in R sig 184, rec mic L sig 172, and the rec mic R sig 174 so that the root-mean-square (RMS) levels exhibit a defined relative separation. For example, and without limitation, the mic preprocessor 220 and the line-in preprocessor 230 may perform scaling operations to ensure that the rec line-in L/R sigs 182/184 are 6 decibels (dB) hotter than the rec mic L/R sigs 172/174.

The time alignment subsystem 240 includes, without limitation, a time alignment analyzer 242 and a delay inserter 248. Together, the time alignment analyzer 242 and a delay inserter 248 modify the rec line-in L/R sigs 182/184 to compensate for any time skew attributable to the propagation distance between the stage mics 112 and the remote mics L/R 142/144. First, the time alignment analyzer 242 cross-correlates the rec mic L/R sigs 172/174 with the rec line-in L/R sigs 182/184 and then sets a mic delay 245 based on the peak of the cross-correlation. Subsequently, to time align the rec mic L/R sigs 172/174 and the rec line-in L/R sigs 182/184, the delay inserter 248 injects the mic delay 245 into the rec line-in L/R sigs 182/184. The delay inserter 248 may inject the time delay in any technically feasible fashion, such as digitally skewing discrete time stamps included in the rec line-in L/R sigs 182/184. Notably, the time alignment subsystem 240 does not modify the rec mic L/R sigs 172/174. In alternate embodiments, without limitation, the time alignment analyzer 242 may include any number of modules, may include any type of delay adjustments, and may insert additional delays in any technical feasible fashion. For example, and without limitation, to retain some ambiance, the time alignment analyzer 242 could be configured to only partially correct the time skew between the rec mic L/R sigs 172/174 and the rec line-in L/R sigs 182/184.

The bass adjustment subsystem 250 includes, without limitation, a bass content analyzer 252 and a bass adjuster 258. The bass content analyzer 252 determines the ratio of bass frequencies to treble frequencies included in the rec line-in L/R sigs 182/184, irrespective of the rec mic L/R sigs 172/174. The bass content analyzer 252 may determine the bass content in any manner as known in the art. For example, in some embodiments, without limitation, the bass content analyzer 252 may perform a low pass filter operation on the rec line-in L/R sigs 182/184 to determine the bass frequencies and perform a high pass filter operation on the rec line-in L/R sigs 182/184 to determine the treble frequencies.

Based on the ratio of bass content to treble content, the bass adjuster 258 performs one or more bass adjustments that are designed to optimize the ratio and quality of the bass included in the recording out L/R sigs 192/194. In some embodiments, and without limitation, if the bass content analyzer 252 determines that the rec line-in L/R sigs 182/184 do not include significant bass content, then the bass adjuster 258 may enhance the bass frequencies included in the rec mic L/R sigs 172/174. One common scenario that could lead to a lack of bass in the rec line-in L/R sigs 182/184 is when bass instruments, such as the bass guitar, are not amplified by components included in the performance system 100 and, consequently, sounds from such instruments are not processed by the console mixer 120.

Conversely, and without limitation, if the bass content analyzer 252 determines that the rec line-in L/R sigs 182/184 include significant bass content, then the bass adjuster 258 attenuates the bass frequencies included in the rec mic L/R sigs 172/174 and amplifies the bass frequencies included in the relatively "clean" rec line-in L/R sigs 182/184. In this fashion, the bass adjuster 258 reduces low frequency noises typically included in the rec mic L/R sigs 172/174 without losing the bass frequencies of the desired sounds. In general, the bass adjuster 258 may perform any number of bass optimization operations in any technically feasible fashion, such as applying a variety of filtering, panning, and amplification operations on the rec mic L/R sigs 172/174 and the rec line-in L/R sigs 182/184. In alternate embodiments, the recording optimizer 150 may include any functionality that modifies the signal content of the rec mic L sig 172, the rec mic R sig 174, the rec line-in L sig 182 and/or the rec line-in R sig 184 in any technically feasible fashion based on the distribution of the signal content across any number of frequency bands.

The panning checker/swapper 260 enforces panning consistency across the rec mic L/R sigs 172/174 and the rec line-in L/R sigs 182/184. The panning checker/swapper 260 may correct for an unintentional direction reversal in any technically feasible fashion. For example, in one embodiment, without limitation, the panning checker/swapper 260 calculates a "normal" cross-correlation and a "reversed" cross-correlation between the rec mic L/R sigs 172/174 and the rec line-in L/R sigs 182/184. If the panning checker-swapper 260 determines that the value of the reversed cross-correlation is higher than the value of the normal cross-correlation, then the panning checker/swapper 260 exchanges the rec line-in L sig 182 and the rec line-in R sig 184. Advantageously, such a swap enforces consistency between the directions of the rec mic L/R sigs 172/174 and the directions of the rec line-in L/R sigs 182/184 irrespective of the absolute angles associated with the left and right directions.

As shown, the subjective customizer 270 receives a subjective delay 274 and a subjective line-in gain 272. The subjective delay 274 is a configurable delay that enables the user (such as an audience member) to restore ambiance that was lost when the time alignment subsystem 240 corrected the time skew between the rec mic L/R sigs 172/174 and the rec line-in L/R sigs 182/184. The subjective line-in gain 272 allows the user to alter the relative contributions of the rec mic L/R sigs 172/174 and the directions of the rec line-in L/R sigs 182/184. For example, and without limitation, the user may select the subjective line-in gain 272 to enhance the contributions of the "purer" rec line-in L/R sigs 182/184 relative to the contributions of the "noisier" rec mic L/R sigs 172/174. The subjective customizer 270 may apply the subjective line-in gain 272 and the subjective delay 274 in any technical feasible fashion, such as adding digital delay, applying filters, etc. to one or more of the rec mic L/R sigs 172/174 and the rec line-in L/R sigs 182/184. In alternate embodiments, the subjective customizer 270 may receive any number and type of additional subjective parameters in any technically feasible fashion (e.g., via a graphical user interface) and may perform any number of adjustments based on these subjective parameters. Further, in some embodiments, the subjective customizer 270 may receive input that enables the sound engineer to over-ride any modifications performed and/or recommended by components (e.g., the bass content analyzer 252, the bass adjuster 258, etc.) included in the recording optimizer 150.

Lastly, the signal combiner 290 receives the rec mic L sig 172, the rec mic R sig 174, the rec line-in L sig 182, and the rec line-in R sig 184 and generates the recording out L sig 192 and the recording out R sig 194. Notably, the rec mic L sig 172, the rec mic R sig 174, the rec line-in L sig 182, and the rec line-in R sig 184 received by the signal combiner 290 reflect the optimization operations performed by the mic preprocessor 220, the line-in preprocessor 230, the time alignment subsystem 240, the bass adjustment subsystem 250, the panning checker/swapper 260, and the subjective customizer 270. In operation, the signal combiner 290 performs a signal addition operation between the rec mic L sig 172 and the rec line-in L sig 182 to generate the fidelity-optimized recording out L sig 192 and another signal addition operation between the rec mic R sig 174 and the rec line-in R sig 184 to generate the fidelity-optimized recording out R sig 194.

In alternate embodiments, the functionality included in the recording optimizer 150 may be distributed between any number and types of units. For example, and without limitation, the mic preprocessor 220 and the line-in preprocessor 230 may be combined into a single signal preprocessor. Further, each of the components included in the recording optimizer 150 may be implemented in any technically feasible fashion using any combination of software, firmware, and hardware. For example, and without limitation, in an entirely software implementation, the recording optimizer 150 could be an application executed by a smartphone. In yet other embodiments, the functionality included in the recorder 150 may be modified to reflect any number of analysis operations and corresponding signal modification operations designed to improve the fidelity of the recording out L/R sigs 192/194.

FIG. 3 depicts excerpts of pseudocode that implement one or more aspects of the recording optimizer 150 of FIG. 2, according to various embodiments. In general, each pseudocode is an excerpt of software that is executed by any number and type of processing units to provide functionality associated with the recording optimizer 150. As shown, the recording optimizer 150 implements a mic preprocessor pseudocode 320, a line-in preprocessor pseudocode 330, a time alignment subsystem pseudocode 340, a bass adjustment subsystem pseudocode 350, a panning checker/swapper pseudocode 360, a subjective customizer pseudocode 370, and a signal combiner pseudocode 390.

In the context of FIG. 3, each of the pseudocodes 320-390 is considered to be executed by one or more processing units (not shown in FIG. 3). As referred to herein, the execution of the pseudocodes 320-390 by a processing unit implements the functionality included in the units of the recording optimizer 150. For example, and without limitation, the mic preprocessor pseudocode 320 is executed by a processing unit and implements the functionality of the mic preprocessor 220. Further, for explanatory purposes, the execution of each of the pseudocodes 320-390 by a processing unit is referred to herein as the pseudocodes 320-390 "performing" or "executing" operations. For example, and without limitation, the operations performed by the processing unit while executing the preprocessor pseudocode 320 are referred to herein as operations performed by the mic preprocessor pseudocode 320.

As shown, the mic preprocessor pseudocode 320 implements the functionality of the mic preprocessor 220—normalizing the signal energy and removing "noise" by performing a high pass filtering operation on the rec mic L/R sigs 172/174 that attenuates noise below 40 Hz. The line-in preprocessor pseudocode 330 implements the functionality of the line-in preprocessor 230—normalizing the signal energy of the rec line-in L sig 182 and the rec line-in R sig 184 and/or performing signal panning operations. First, the line-in preprocessor pseudocode 330 performs a cross-correlation operation between the rec line-in L sig 182 and the rec line-in R sig 184. If the cross-correlation is higher than 0.7 (indicative of a predetermined maximum panning width), then the line-in preprocessor pseudocode 330 normalizes the signal energy of the rec line-in L sig 182 and the rec line-in R sig 184. By contrast, if the cross-correlation is lower than 0.7, then the line-in preprocessor pseudocode 330 reduces the panning width by replacing 40% of the rec line-in L sig 182 with 40% the rec line-in R sig 184 and replacing 40% of the rec line-in R sig 184 with 40% of the rec line-in L sig 182.

The time alignment subsystem pseudocode 340 implements the functionality of the time alignment analyzer 242. Upon execution by a processing unit, the time alignment subsystem pseudocode 340 cross-correlates the sum of the rec mic L/R sigs 172/174 with the sum of the rec line-in L/R sigs 182/184. The time alignment subsystem pseudocode 240 then assigns the mic delay 245 based on the peak of the cross-correlation, and digitally delays both the rec line-in L sig 182 and the rec line-in R sig 184 based on the mic delay 245.

The bass adjustment subsystem pseudocode 350 implements the functionality of the bass content analyzer 252. First, the bass adjustment subsystem pseudocode 350 performs a low pass analysis filter operation on the sum of the rec line-in L/R sigs 182/184 to determine the content of the rec line-in L/R sigs 182/184 below 130 Hz ("line bass"). In a complementary manner, the bass adjustment subsystem pseudocode 350 performs a high pass analysis filter operation on the sum of the rec line-in L/R sigs 182/184 to determine the content of the rec line-in L/R sigs 182/184 above 130 Hz ("line treble"). If the level of the line bass is greater than the 20% of the level of the line treble, then the bass adjustment subsystem pseudocode 350 determines that bass is present in the rec line-in L/R sigs 182/184. If the level of the line bass is not greater than 20% of the level of the line bass, then the bass adjustment subsystem pseudocode 350 determines that bass is absent in the rec line-in L/R sigs 182/184.

The bass adjustment subsystem pseudocode 350 then optimizes the content included in the rec line-in L/R sigs 182/184 and/or the rec mic L/R sigs 172/174 by frequency. In particular, if bass is present in the rec line-in L/R sigs 182/184, then the bass adjustment subsystem pseudocode 350 performs a high pass filtering operation on the rec mic L/R sigs 172/174 to attenuate signal components with frequencies below 130 Hz. Subsequently, the bass adjustment subsystem pseudocode 350 performs a band pass filtering operation on the rec line-in L/R sigs 182/184 to boost the non-noise bass components of the signal (between 30 Hz and 130 Hz) by 6 decibels, and preserves the mid and high components of the rec line-in L/R sigs 182/184. Such a combination of filtering and amplification operations enhances the bass frequencies included in the rec line-in L/R sigs 182/184, which will typically be exposed to less noise than the rec mic L/R sigs 172/174, while preserving some of the ambiance provided by the rec mic L/R sigs 172/174.

By contrast, if bass is not present in the rec line-in L/R sigs 182/184, then the bass adjustment subsystem pseudocode 350 performs a band pass filtering operation on the rec mic L/R sigs 172/174 to boost the non-noise bass components of the signal (between 30 Hz and 130 Hz), and preserve the mid and high components of the rec mic L/R sigs 172/174 by 6 decibels. Such a combination of filtering and amplification operations ensures that the bass frequencies that are omitted from the original rec line-in L/R sigs 182/184 are appropriately represented in a mix of the modified rec mic L sigs 172/174 and the modified rec line-in L/R sigs 182/184.

Upon execution by a processing unit, the panning checker/swapper pseudocode 360 implements the functionality of the panning checker/swapper 260. In particular, the panning checker/swapper pseudocode 360 enforces panning consistency across the rec mic L/R sigs 172/174 and the rec line-in L/R sigs 182/184. First, the panning checker/swapper 260 calculates a "normal" cross-correlation as the sum of the cross-correlation between the rec mic L sig 172 and the rec line-in L sig 182 and the cross-correlation between the rec mic R sig 174 and the rec line-in R sig 184. The panning checker/swapper 260 then calculates the "reversed" cross-correlation as the sum of the cross-correlation between the rec mic L sig 172 and the rec line-in R sig 184 and the cross-correlation between the rec mic R sig 174 and the rec line-in L sig 182. If the panning checker/swapper 260 determines that the reversed cross-correlation is greater than the normal cross-correlation, then the panning checker/swapper pseudocode 360 determine that the directions (e.g., left/right) of the rec mic L/R sigs 172/174 are inconsistent with the directions of the rec mic L/R sigs 172/174. To correct this direction reversal, the panning checker/swapper pseudocode 360 swaps the rec line-in L sig 182 with the rec line-in R sig 184.

The subjective customizer pseudocode 370, when executed by a processing unit, implements the subjective customizer 270—receiving and applying the subjective delay 274 and the subjective line-in gain 272. As shown, the subjective customizer pseudocode 370 digitally delays both the rec mic L sig 172 and the rec mic R sig 174 by the subjective delay 274. Such a delay may partially reduce the correction imposed by the time alignment subsystem pseudocode 340, causing the rec mic L sig 172 and the rec mic R sig 174 to be perceived at some distance from the stage (based on the subjective delay 274). Consequently, applying the subjective delay 274 may restore a pre-determined amount of ambiance to the rec mic L/R sigs 172/174. Further, the subjective customizer pseudocode 370 multiplies both the rec line-in L sig 182 and the rec line-in R sig 184 by the subjective line-in gain 272, thereby amplifying rec line-in L/R sigs 182/184 to reflect a predetermined preference.

Finally, the signal combiner pseudocode 390 configures the signal combiner 290 to generate the recording out L/R sigs 192/194. In particular, when executed by a processing unit, the signal combiner pseudocode 390 performs signal addition operations between the compensated rec mic L sig 172 and the compensated rec line-in L sig 182 to generate the recording out L sig 192. Similarly, the signal combiner pseudocode 390 performs signal addition operations between the compensated rec mic R sig 174 and the compensated rec line-in R sig 184 to generate the recording out R sig 194.

Notably, the pseudocodes 320-390 depicted in FIG. 3 are to be regarded in an illustrative rather than a restrictive sense. In alternate embodiments, the functionality and predetermined parameters, such as the maximum panning width, included in each of the pseudocodes 320-390, may be modified based on any number of variables including, without limitation, user preferences, performance system structure, type of remote recording event, etc. Further, the functionality included in each of the pseudocodes 320-390 may be replaced or supplemented with any type of hardware element, such as a filter and/or amplifier. Finally, the pseudocodes 320-290 may be executed by any type of processing unit and/or implemented within any type of computing device.

Figure 4:
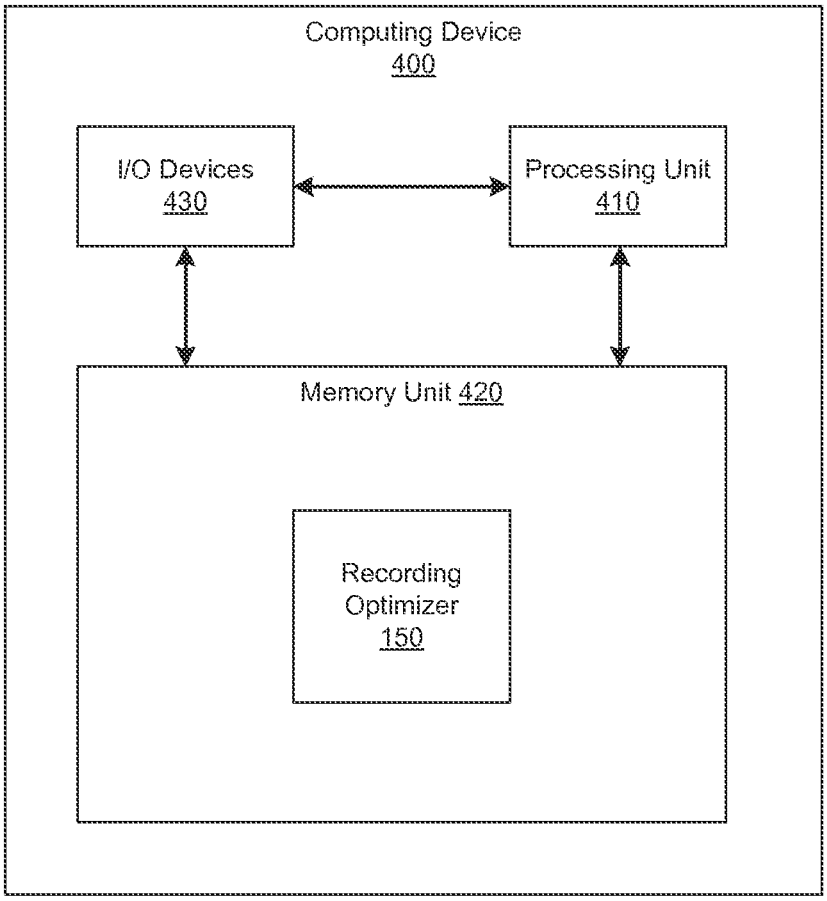
FIG. 4 illustrates a computing device within which one or more aspects of the recording optimizer of FIG. 1 may be implemented, according to various embodiments.

FIG. 4 illustrates a computing device 400 within which one or more aspects of the recording optimizer 150 of FIG. 1 may be implemented, according to various embodiments. The computing device 400 may be any type of device capable of executing application programs including, and without limitation, application programs included in the recording optimizer 150. For example, and without limitation, the computing device 400 may be configured to execute any number and combination of the mic preprocessor pseudocode 320, the line-in preprocessor pseudocode 330, the time alignment subsystem pseudocode 340, the bass adjustment subsystem pseudocode 350, the panning checker/swapper pseudocode 360, the subjective customizer pseudocode 370, and the signal combiner pseudocode 390. As shown, the computing device 400 includes, without limitation, a processing unit 410, a memory unit 420, and input/output (I/O) devices 430.

The processing unit 410 may be implemented as a central processing unit (CPU), digital signal processing unit (DSP), graphics processor unit (GPU), and so forth. Among other things, and without limitation, the processing unit 410 executes one or more application programs that implement the recording optimizer 150 and are stored in the memory unit 420 and/or external memory accessible by the processing unit 410, such as a Secure Digital Card, external Flash memory, a portable compact disc read-only memory (CD-ROM), an optical storage device, a magnetic storage device, or any suitable combination of the foregoing.

The memory unit 420 may include a memory module or collection of memory modules that provide storage space accessible by the processing unit 410. In some embodiments, without limitation, any number and combination of the mic preprocessor pseudocode 320, the line-in preprocessor pseudocode 330, the time alignment subsystem pseudocode 340, the bass adjustment subsystem pseudocode 350, the panning checker/swapper pseudocode 360, the subjective customizer pseudocode 370, and the signal combiner pseudocode 390 may be stored in the memory unit 240. The I/O devices 430 may include input devices, output devices, and devices capable of both receiving input and providing output and may enable any communication protocols. For example, and without limitation, the I/O devices 430 may include Smart WiFi and Bluetooth interfaces.

In alternate embodiments, the computing device 400 may be replaced and/or supplemented with any number of signal processing components that facilitate the operation of the recorder 140. For example, and without limitation, instead of the computing device 400, the recorder 140 may include components that implement a variety of filters, digital to analog converters, dynamic amplifiers, etc. that are configured to implement the functionality included in the recording optimizer 150.

In general, and without limitation, the computing device 400 may be implemented as a stand-alone chip or as part of a more comprehensive solution that is implemented as an application-specific integrated circuit (ASIC), a system-on-a-chip (SoC), and so forth. Further, the computing device 400 may be incorporated into the recorder 140 of FIG. 1 in any technically feasible fashion and as any number of discrete or integrated units. For example, and without limitation, each of the processing unit 410, the memory unit 420, and the I/O devices 430 may be embedded in or mounted on a laptop, a tablet, a smartphone, or the like that implements the recorder 140. In other embodiments, without limitation, the recorder 140 may be implemented as a handheld recording unit. In general, the embodiments disclosed herein contemplate any technically feasible system configured to implement the functionality included in various components of the recording optimizer 150 in any combination.

Figure 5:
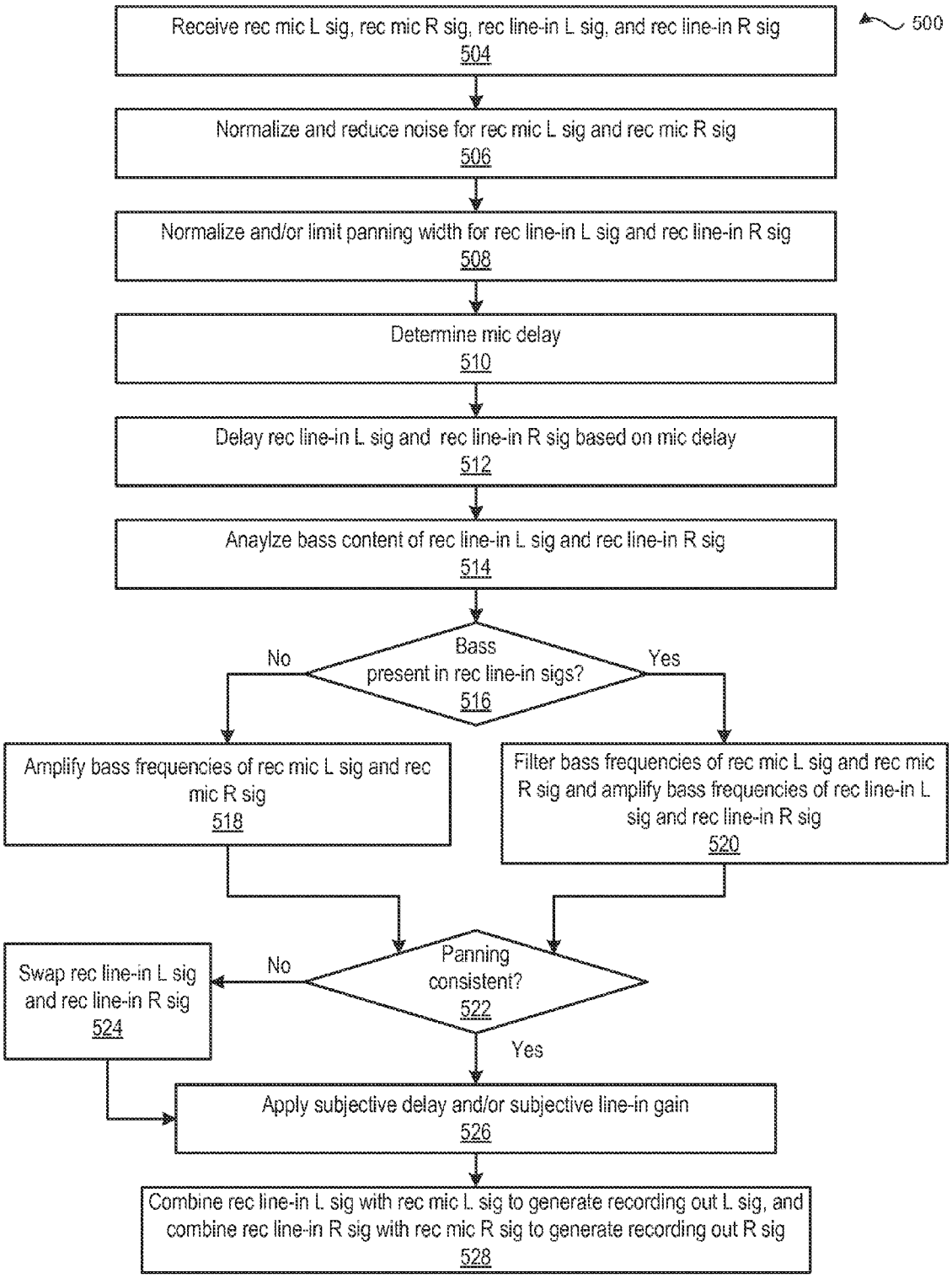
FIG. 5 is a flow diagram of method steps for generating a remote recording of a performance, according to various embodiments.

FIG. 5 is a flow diagram of method steps for generating a remote recording of a performance, according to various embodiments. Although the method steps are described in conjunction with the systems of FIGS. 1-4 persons skilled in the art will understand that any system configured to implement the method steps, in any order, falls within the scope of the various embodiments.

As shown, a method 500 begins at step 504, where the recording optimizer 150 receives the recorded microphone left signal (rec mic L sig) 172, the recorded microphone right signal (rec mic R sig) 174, the recorded line-input left signal (rec line-in L sig) 182, and the recorded line-input right signal (rec line-in R sig) 184. The recording optimizer 150 may receive the rec mic L sig 172, the rec mic R sig 174, the rec line-in L sig 182, and the rec line-in R sig 184 in any technically feasible fashion. For example and without limitation, the recorder 140 and the recording optimizer 150 could be implemented in separate units, and the recorder 140 could transmit the rec mic L sig 172, the rec mic R sig 174, the rec line-in L sig 182, and the rec line-in R sig 184 to the recording optimizer 150 using any wired or wireless communication protocol. In alternate embodiments, without limitation, the recorder 140 may be any remote recording device and may include any number of microphone signals and any number of line-in signals. In various embodiments, without limitation, the recording optimizer 150 may be implemented within the remote recording device or implemented externally to the remote recording device.

At step 506, the mic preprocessor 220 performs level normalization and noise reduction operations on the rec mic L sig 172 and the rec mic R sig 174. More specifically, to perform level normalization, the microphone preprocessor 220 amplifies the rec mic L sig 172 and the rec mic R sig 174 to fully utilize an available dynamic range. For example, and without limitation, if sixteen bits were to be available for encoding volume levels, then the microphone preprocessor 220 could scale each of the rec mic L sig 172 and the mic R sig to span sixteen bits. The microphone preprocessor 220 may implement noise reduction in any technically feasible fashion. In some embodiments, to reduce low-frequency noises, the microphone preprocessor 220 may perform a high pass filtering operation that significantly attenuates signals with frequencies lower than those at which desired sounds are likely to occur (e.g., 40 Hertz). The mic preprocessor 220 may implement the level normalization and noise reduction operations in hardware, software, or a combination or hardware and software.

At step 508, the line-in preprocessor 230 performs level normalization and/or panning reduction operations on the rec line-in L sig 182 and the rec line-in R sig 184. To perform level normalization, the line-in preprocessor 230 amplifies the rec line-in L sig 182 and the rec line-in R sig 184 to fully utilize an available dynamic range. Typically, the available dynamic range implemented by the line-in preprocessor 230 matches the available dynamic range implemented by the mic preprocessor 220 and, consequently, the rec line-in L sig 182, the rec line-in R sig 184, rec mic L sig 172, the rec mic R sig 174 are normalized to the same scale. Advantageously, by enforcing consistent level normalization, the mic preprocessor 220 and the line-in preprocessor 230 negate any differences in average levels between the rec line-in L/R sigs 182/184 and the rec mic L/R sigs 172/174. For example, and without limitation, the mic preprocessor 220 and the line-in preprocessor 230, together, may balance differences in the signal energy attributable to variances in the sensitivity of the microphones included in the recorder 140 and the output voltage of the console mixer 120.

The line-in preprocessor 230 may perform any number and type of panning reduction operations. For example, and without limitation, in a relatively wide pan, some instruments will be included in the rec line-in L sig 182 but will not be included in the rec line-in R sig 184, while other instruments will not be included in the rec line-in L sig 182 but will be included in the rec line-in R sig 184. While such a wide pan may be desirable for some types of special effects implemented by the console mixer 120, typically a wide pan is not replicated in the rec mic L/R sigs 172/174 and, consequently, the wide pan could corrupt a mix of the rec line-in L/R sigs 182/184 and the rec mic L/R sigs 172/174. Accordingly, in some embodiments and without limitation, the line-in preprocessor 230 may reduce the spread of the panning by adjusting the relative contributions of the rec line-in L sig 182 and the rec line-in R sig 184. As detailed previously herein, one panning reduction technique method that the line-in preprocessor 230 may implement, without limitation, is depicted in the line-in preprocessor pseudocode 330.

At step 510, the time alignment analyzer 242 determines the mic delay 245—the time skew between the rec mic L/R sigs 172/174 and the rec line-in L/R sigs 182/184. Because the rec line-in L/R sigs 182/184 are typically generated via stage mics 112 that are proximally located to the source of the corresponding sounds (e.g., instruments on the stage 110), the mic delay 245 typically correlates to the roughly the distance between the recorder 140 and the stage 110. In some embodiments, without limitation, since the distance between the recorder 140 and the stage 110 may be unknown, the time alignment analyzer 242 cross-correlates the rec mic L/R sigs 172/174 with the rec line-in L/R sigs 182/184 and then sets the mic delay 245 based on the peak of the cross-correlation. At step 512, to time align the rec mic L/R sigs 172/174 and the rec line-in L/R sigs 182/184, the delay inserter 248 delays the rec line-in L/R sigs 182/184 based on the mic delay 245. The delay inserter 248 may insert the time delay in any technically feasible fashion, such as digitally skewing discrete time stamps included in the rec line-in L/R sigs 182/184.

At step 514, the bass content analyzer 252 determines the bass content of the rec line-in L/R sigs 182/184. In particular, the bass content analyzer 252 determines the ratio of bass frequencies to treble frequencies included in the rec line-in L/R sigs 182/184. The bass content analyzer 252 may determine the bass content in any manner as known in the art. For example, in some embodiments, without limitation, the bass content analyzer 252 may perform a low pass analysis filter operation on the rec line-in L/R sigs 182/184 to determine the bass frequencies and perform a high pass analysis filter operation on the rec line-in L/R sigs 182/184 to determine the treble frequencies.

At step 516, the bass content analyzer 252 determines whether the rec line-in L/R sigs 182/184 includes significant bass content. If, at step 516, the bass content analyzer 252 determines that the rec line-in L/R sigs 182/184 do not include significant bass content, then the method 500 proceeds to step 518. One common scenario that could lead to a lack of bass in the rec line-in L/R sigs 182/184 is when bass instruments, such as the bass guitar, are not amplified and, consequently, sounds from such instruments are not processed by the console mixer 120. At step 518, to ensure that bass frequencies are not underrepresented in a mix of the rec mic L/R sigs 172/174 and the rec line-in L/R sigs 182/184, the bass adjuster 258 enhances the bass frequencies included in the rec mic L/R sigs 172/174. For example and without limitation, in some embodiments, the bass adjuster 258 performs a band pass filter operation that identifies the appropriate bass frequencies included in the rec mic in L/R sigs 172/174 and then amplifies the identified bass frequencies (while preserving the mid and upper frequencies). The method 500 then continues directly to step 522.

If, however, at step 516, the bass content analyzer 252 determines that the rec line-in L/R sigs 182/184 include significant bass content, then the method 500 proceeds to step 520. At step 520, to reduce the low frequency noise typically included in the rec mic L/R sigs 172/174 without losing the bass frequencies of the desired sounds, the bass adjuster 258 attenuates the bass frequencies included in the rec mic L/R sigs 172/174 and amplifies the bass frequencies included in the relatively "clean" rec line-in L/R sigs 182/184. The bass adjuster 258 may perform these bass optimization operations in any technically feasible fashion, such as applying a variety of filtering and amplification operations on rec mic L/R sigs 172/174 and the rec line-in L/R sigs 182/184.

At step 522, the panning checker/swapper 260 determines whether the panning is consistent across the rec mic L/R sigs 172/174 and the rec line-in L/R sigs 182/184. As part of step 522, the panning checker/swapper 260 determines the "normal" cross-correlation and the "reversed" cross-correlation between the rec mic L/R sigs 172/174 and the rec line-in L/R sigs 182/184. More specifically, the panning checker/swapper 260 calculates the normal cross-correlation as the sum of the cross-correlation between the rec mic L sig 172 and the rec line-in L sig 182 and the cross-correlation between the rec mic R sig 174 and the rec line-in R sig 184. Similarly, the panning checker/swapper 260 calculates the reversed cross-correlation as the sum of the cross-correlation between the rec mic L sig 172 and the rec line-in R sig 184 and the cross-correlation between the rec mic R sig 174 and the rec line-in L sig 182. If the panning checker/swapper 260 determines that the normal cross-correlation is greater than or equal to the reversed cross-correlation, then the method 500 proceeds directly to step 526.

If, however, at step 522, the panning checker/swapper 260 determines that the reversed cross-correlation is greater than the normal cross-correlation, then the method 500 proceeds to step 524. At step 524, because the cross-correlations indicate that the directions (e.g., left/right) of the rec mic L/R sigs 172/174 are inconsistent with the directions of the rec mic L/R sigs 172/174, the panning checker/swapper 260 swaps the rec line-in L sig 182 with the rec line-in R sig 184. Notably, such a swap enforces consistency between the directions of the rec mic L/R sigs 172/174 and the directions of the rec line-in L/R sigs 182/184 irrespective of the absolute angles associated with the left and right directions.

At step 526, the subjective customizer 270 receives and applies the subjective line-in gain 272 and the subjective delay 274. The subjective customizer 270 may receive, determine, and/or apply the subjective line-in gain 272 and the subjective delay 274 in any technically feasible fashion. For example, and without limitation, the subjective customizer 270 may obtain the subjective line-in gain 272 and the subjective delay 274 via a user interface that enables the user to assign the subjective line-in gain 272 and the subjective delay 274 via one or more graphical user interface widgets, such as sliders. In some embodiments, the subjective line-in gain 272 enables the user to alter the relative contributions of the rec mic L/R sigs 172/174 and the directions of the rec line-in L/R sigs 182/184 and the subjective delay 274 enables the user to restore ambiance that was lost during the time alignment operations. In alternate embodiments, the subjective customizer 270 may receive any number and type of additional subjective parameters and may perform any number of adjustments based on these subjective parameters.

At step 528 the signal combiner 290 generates the recording out L/R sigs 192/194. In particular, the signal combiner 290 performs addition operations between the compensated rec mic L sig 172 and the compensated rec line-in L sig 182 to generate the recording out L sig 192. Similarly, the signal combiner 290 performs addition operations between the compensated rec mic R sig 174 and the compensated rec line-in R sig 184 to generate the recording out R sig 194. Advantageously, because the recording optimizer 150 performs a variety of compensation operations that leverage the strength of each of the constituent signals while avoiding inappropriate representation of individual signal components, the fidelity of the recording out L/R sigs 192/194 is optimized.

In sum, the disclosed techniques may be used to optimize the output signals generated by a recorder to represent a remote audio performance. The recorder includes, without limitation, a recording optimizer, stereo microphones that capture sounds as perceived at the location of the recorder, and stereo line-inputs that are generated by a front of house console mixer. In operation, the recorder receives and records (i.e., stores) acoustic audio signals via the stereo microphones and electronic audio signals via the stereo line-inputs. The recording optimizer then preprocesses the recorded acoustic audio signals and the recorded electronic audio signals to remove distortions attributable to the signal source. For example, the recorder optimizer may remove low frequencies that typically corresponding to undesired ambient noises from the recorded acoustic audio signals, and/or the recorder optimizer may narrow panning exhibited by the recorded electronic audio signals.

After preprocessing the recorded acoustic audio signals and the recorded electronic audio signals, the recording optimizer analyzes these recorded audio signals to identify discrepancies in signal content. Such discrepancies may include, without limitation, differences in the components included in the recorded audio signals (e.g., contributions from a bass guitar included in the recorded acoustic audio signals but not in the recorded electronic audio signals), time delays, differing volume levels, and the like. Based on the identified discrepancies, the recording optimizer performs compensation operations to ensure that the recorded acoustic audio signals and the recorded electric audio signals, when summed together, do not overrepresent or underrepresent any components of the audio performance. Further, the recording optimizer identifies optimization opportunities, such as selectively decreasing contributions from the recorded acoustic audio signals and increasing contribution from the recorded electronic audio signals to reflect the high fidelity inherent in the recorded electronic audio signals. Finally, after performing the compensation operations, the recording optimizer combines the compensated signals, thereby generating stereo output signals that optimally represent the audio performance.

At least one advantage of the disclosed approach is that the output signals produced by the recording optimizer more accurately represent the listening experience than output signals generated by conventional recording/mixer combinations that indiscriminately combine acoustic audio signals and electronic audio signals. More specifically, the recording optimizer alters components (e.g., frequency bands) included in the recorded acoustic audio signals and the recorded electronic audio signals to ensure that, when combined, each component is appropriately represented in the output signals generated by the recording optimizer. Further, the recording optimizer aligns the signals by time, normalizes the signals by volume level, and emphasizes the contributions of "purer" source signals. Consequently, the recording mixer enables the recorder to produce higher fidelity output signals than conventional recorder/mixer combinations that either rely exclusively on acoustic audio signals or naively combine acoustic audio signals and electronic audio signals.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The various embodiments have been described above with reference to specific embodiments. Persons of ordinary skill in the art, however, will understand that various modifications and changes may be made thereto without departing from the broader spirit and scope of the various embodiments as set forth in the appended claims. For example, and without limitation, although many of the descriptions herein refer to specific types of audiovisual equipment and sensors, persons skilled in the art will appreciate that the systems and techniques described herein are applicable to other types of performance output devices (e.g., lasers, fog machines, etc.) and sensors. The foregoing description and drawings are, accordingly, to be regarded in an illustrative rather than a restrictive sense.

While the preceding is directed to embodiments of the present disclosure, other and further embodiments of the disclosure may be devised without departing from the basic scope thereof, and the scope thereof is determined by the claims that follow.

What is claimed is:

1. A computer-implemented method for generating a remote recording of a first performance, the method comprising:

performing a first amplification operation on a first source audio signal to utilize a first dynamic range, wherein the amplification operation produces a first audio input signal, performing a second amplification operation on a second source audio signal to utilize a second dynamic range, wherein the second amplification operation produces a second audio input signal and the second dynamic range matches the first dynamic range, detecting a discrepancy between the first audio input signal associated with the first performance and the second audio input signal associated with the first performance, performing a compensation operation on the first audio input signal based on the discrepancy to generate a first compensated signal, and combining the first compensated signal and the second audio input signal to generate a first audio mix signal comprising the remote recording of the first performance.

2. The method of claim 1, wherein the first audio input signal comprises a recording of an electronic signal received via a line-in input, and the second audio input signal comprises a recording of an acoustic signal received via a microphone.

3. The method of claim 1, wherein the first audio input signal comprises a recording of an acoustic signal received via a microphone located within a first portion of a performance area, and the second audio input signal comprises a recording of an electronic signal associated with the first portion of the performance area and received via a line-in input.

4. The method of claim 3, further comprising:

performing a second compensation operation on a third audio input signal to generate a second compensated signal, wherein the third audio input signal comprises a recording of an acoustic signal received via a microphone located within a second portion of the performance area; and combining the second compensated signal with a recording of an electronic signal associated with the second portion of the performance area to generate a second audio mix signal.

5. The method of claim 1, wherein the discrepancy comprises a panning inconsistency, the first audio input signal comprises a recording of an acoustic signal received via a microphone located within a first portion of a performance area, and performing the compensation operation comprises replacing the first audio input signal with a recording of an acoustic signal received via a microphone located within a second portion of the performance area.

6. The method of claim 1, wherein the discrepancy comprises a propagation time delay between the first audio input signal and the second audio input signal, and performing the compensation operation comprises shifting the first audio input signal based on the propagation time delay.

7. The method of claim 1, wherein the discrepancy comprises a difference between a range of low frequencies included in the first audio input signal and a range of low frequencies included in the second audio input signal, and performing the compensation operation comprises adjusting a gain associated with the range of low frequencies included in the first audio input signal.

8. The method of claim 1, further comprising receiving the first source audio signal, and performing one or more normalization operations on the first source audio signal to produce the first audio input signal.

9. A non-transitory, computer-readable storage medium including instructions that, when executed by a processor, cause the processor to generate a remote recording of a first performance by performing the steps of:

performing a first amplification operation on a first source audio signal to utilize a first dynamic range, wherein the amplification operation produces a first audio input signal, performing a second amplification operation on a second source audio signal to utilize a second dynamic range, wherein the second amplification operation produces a second audio input signal and the second dynamic range matches the first dynamic range, detecting a discrepancy between the first audio input signal associated with the first performance and the second audio input signal associated with the first performance, performing a compensation operation on the first audio input signal based on the discrepancy to generate a first compensated signal, and combining the first compensated signal and the second audio input signal to generate a first audio mix signal comprising the remote recording of the first performance.

10. The non-transitory computer-readable storage medium of claim 9, wherein the first audio input signal comprises a recording of an electronic signal received via a line-in input, and the second audio input signal comprises a recording of an acoustic signal received via a microphone.

11. The non-transitory computer-readable storage medium of claim 9, wherein the first audio input signal comprises a recording of an acoustic signal received via a microphone located within a first portion of a performance area, and the second audio input signal comprises a recording of an electronic signal associated with the first portion of the performance area and received via a line-in input.

12. The non-transitory computer-readable storage medium of claim 11, further comprising:

performing a second compensation operation on a third audio input signal to generate a second compensated signal, wherein the third audio input signal comprises a recording of an acoustic signal received via a microphone located within a second portion of the performance area; and combining the second compensated signal with a recording of an electronic signal associated with the second portion of the performance area to generate a second audio mix signal.

13. The non-transitory computer-readable storage medium of claim 9, further comprising receiving the first source audio signal and performing a filtering operation to reduce ambient noise, wherein the filtering operation produces the first audio input signal.

14. The non-transitory computer-readable storage medium of claim 9, wherein the discrepancy comprises a difference between a range of low frequencies included in the first audio input signal and a range of low frequencies included in the second audio input signal, and performing the compensation operation comprises adjusting a gain associated with the range of low frequencies included in the first audio input signal.

15. A recording device, comprising:

one or more preprocessors configured to:

perform a first amplification operation on a first source audio signal to utilize a first dynamic range, wherein the amplification operation produces a first audio input signal, and perform a second amplification operation on a second source audio signal to utilize a second dynamic range, wherein the second amplification operation produces a second audio input signal and the second dynamic range matches the first dynamic range, a recorder that is coupled to the one or more preprocessors and configured to store the first audio input signal and the second audio input signal; and a recording optimizer that is coupled to the recorder and is configured to:

detect a discrepancy between the first audio input signal associated with the first performance and the second audio input signal associated with the first performance, perform a compensation operation on the first audio input signal based on the discrepancy to generate a first compensated signal, and combine the first compensated signal and the second audio input signal to generate a first audio mix signal comprising a recording of the first performance.

16. The recording device of claim 15, wherein the recording optimizer is further configured to perform one or more panning operations that reduce the width of the panning between a first source audio signal associated with a first portion of a performance area and a second source audio signal associated with a second portion of the performance area, wherein a first panning operation included in the one or more panning operations produces the second audio input signal.

17. The recording device of claim 15, wherein combining the first compensated signal and the second audio input signal comprises:

applying at least one of a predetermined subjective gain and a predetermined subjective delay to the second audio input signal to generate a second compensated signal; and performing one or more summation operations on the first compensated signal and the second compensated signal.

18. The recording device of claim 15, wherein the recorder is further configured to store an electronic signal received via a line-in input as the second audio input signal.

19. The recording device of claim 18, wherein the first audio input signal comprises a recording of an acoustic signal received via a microphone located within a first portion of a performance area, and the second audio input signal is associated with the first portion of the performance area.

20. A computer-implemented method for generating a remote recording of a first performance, the method comprising:

detecting a discrepancy between a first audio input signal associated with the first performance and a second audio input signal associated with the first performance, wherein the first audio input signal comprises a recording of an electronic signal received via a line-in input and the second audio input signal comprises a recording of an acoustic signal received via a microphone;

performing a compensation operation on the first audio input signal based on the discrepancy to generate a first compensated signal; and combining the first compensated signal and the second audio input signal to generate a first audio mix signal comprising the remote recording of the first performance.

21. A computer-implemented method for generating a remote recording of a first performance, the method comprising:

detecting a discrepancy between a first audio input signal associated with the first performance and a second audio input signal associated with the first performance, wherein the first audio input signal comprises a recording of an acoustic signal received via a microphone located within a first portion of a performance area, and the second audio input signal comprises a recording of an electronic signal associated with the first portion of the performance area and received via a line-in input;

performing a compensation operation on the first audio input signal based on the discrepancy to generate a first compensated signal; and combining the first compensated signal and the second audio input signal to generate a first audio mix signal comprising the remote recording of the first performance.

22. A recording device, comprising:

a microphone configured to generate a live audio input signal associated with a first performance;

a recorder that is coupled to the microphone and configured to:

store the live audio input signal as a first audio input signal; and store an electronic signal received via a line-in input as a second audio input signal; and a recording optimizer that is coupled to the recorder and is configured to:

detect a discrepancy between the first audio input signal and the second audio input signal associated with the first performance, perform a compensation operation on the first audio input signal based on the discrepancy to generate a first compensated signal, and combine the first compensated signal and the second audio input signal to generate a first audio mix signal comprising the remote recording of the first performance.

* * * * *